US010633240B2

(12) United States Patent
Jaillet, Jr.

(10) Patent No.: US 10,633,240 B2
(45) Date of Patent: Apr. 28, 2020

(54) BEER LINE ADAPTER

(71) Applicant: Donald J Jaillet, Jr., Sutton, MA (US)

(72) Inventor: Donald J Jaillet, Jr., Sutton, MA (US)

( * ) Notice: Subject to any disclaimer, the term of this patent is extended or adjusted under 35 U.S.C. 154(b) by 0 days.

(21) Appl. No.: 15/890,213

(22) Filed: Feb. 6, 2018

(65) Prior Publication Data

US 2019/0010044 A1 Jan. 10, 2019

Related U.S. Application Data

(60) Provisional application No. 62/455,383, filed on Feb. 6, 2017.

(51) Int. Cl.

| | |
|---|---|
| ***B67D 1/12*** | (2006.01) |
| ***B67D 1/08*** | (2006.01) |
| ***B67D 1/07*** | (2006.01) |
| *B67D 1/04* | (2006.01) |
| *B08B 9/032* | (2006.01) |

(52) U.S. Cl.

CPC ..... *B67D 1/1245* (2013.01); *B67D 1/07* (2013.01); *B67D 1/0835* (2013.01); *B08B 9/0328* (2013.01); *B67D 1/04* (2013.01); *B67D 1/0829* (2013.01)

(58) Field of Classification Search

CPC .. B67D 1/1245; B67D 1/0829; B67D 1/0831; B67D 1/0835

See application file for complete search history.

(56) References Cited

U.S. PATENT DOCUMENTS

| | | | | | |
|---|---|---|---|---|---|
| 3,782,609 | A * | 1/1974 | Zucconi | B67D 1/0829 | 137/209 |
| 3,908,871 | A * | 9/1975 | Gottwald | B67D 1/0829 | 137/212 |
| 5,090,440 | A * | 2/1992 | Ladouceur | B08B 9/0323 | 137/209 |
| 5,356,045 | A * | 10/1994 | Parks | B67D 1/0802 | 220/214 |
| 6,098,672 | A * | 8/2000 | Kiholm | B67D 7/0238 | 141/1 |
| 7,686,043 | B2 * | 3/2010 | Berger | B65B 39/00 | 141/286 |
| 2004/0124216 | A1 * | 7/2004 | Payne | B67D 1/0829 | 222/400.7 |
| 2006/0175352 | A1 * | 8/2006 | Emmendorfer | B08B 9/0325 | 222/148 |

FOREIGN PATENT DOCUMENTS

| | | | | |
|---|---|---|---|---|
| GB | 2272893 | * | 6/1994 | B67D 1/07 |
| GB | 2415952 | * | 1/2006 | |

* cited by examiner

*Primary Examiner* — J C Jacyna
(74) *Attorney, Agent, or Firm* — Gerry A. Blodgett; David J. Blodgett; Blodgett & Blodgett, P.C.

(57) ABSTRACT

An adapter, a system, and a method of capturing liquid from a feed line of a liquid delivery system, the liquid delivery system including liquid container, a delivery tap, a gas source, a liquid delivery line from the liquid container to the tap, the liquid delivery line containing liquid, and a gas line from the gas source to the liquid container, the gas line containing gas; by disconnecting the gas line and the liquid delivery line from the liquid container, and flowably connecting the gas line to the liquid delivery line, using an adapter, and pushing the liquid in the liquid delivery line out through the tap.

1 Claim, 6 Drawing Sheets

BEER LINE ADAPTER

CROSS-REFERENCE TO RELATED APPLICATIONS

This application claims the benefit under 35 U.S.C. § 119(e) of U.S. Provisional Application No. 62/455,383 filed Feb. 6, 2017, which is hereby incorporated by reference.

STATEMENT REGARDING FEDERALLY SPONSORED RESEARCH OR DEVELOPMENT

This invention has been created without the sponsorship or funding of any federally sponsored research or development program.

FIELD OF THE INVENTION

This invention involves a system for capturing liquid in a liquid delivery system, prior to cleaning the lines in the liquid delivery system.

BACKGROUND OF THE INVENTION

Prior systems for removing the residual liquid in the lines of a liquid delivery system for dispensing liquids such as draft beer, involved draining, discarding, and therefore wasting, the residual liquid. Because the lines from the liquid source to the tap are often long, discarded residual liquid can involve significant economic loss, especially because this removal of residual liquid must be done frequently because line cleaning must be done frequently. Furthermore, disposing of the coventiall rained residual liquid involves a significant labor and environmental problem.

These and other difficulties experienced with the prior art devices have been obviated in a novel manner by the present invention.

It is, therefore, an outstanding object of some embodiments of the present invention to provide a system for emptying the residual liquid from a liquid delivery system, prior to cleaning the lines, so that the residual liquid is delivered to the tap, instead of disposing of and wasting the residual liquid, the process being conducted in an efficient and effective manner.

Another object of some embodiments of the present invention is to provide a system for preparing a liquid delivery system for line cleaning in a simple, quick, convenient, efficient, and cost-effective manner.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention is processes and equipment for preparing a liquid delivery system for line cleaning, by allowing residual liquid in the lines to be dispensed in the normal way through the tap, rather than being drained, disposed of, and wasted.

The invention is an adapter, a system, and a method of capturing liquid from a feed line of a liquid delivery system, the liquid delivery system including liquid container, a delivery tap, a gas source, a liquid delivery line from the liquid container to the tap, the liquid delivery line containing liquid, and a gas line from the gas source to the liquid container, the gas line containing gas; by disconnecting the gas line and the liquid delivery line from the liquid container, and flowably connecting the gas line to the liquid delivery line, using an adapter, and pushing the liquid in the liquid delivery line out through the tap.

BRIEF DESCRIPTION OF THE DRAWINGS

The character of the invention, however, may best be understood by reference to one of its structural forms, as illustrated by the accompanying drawings, in which.

DETAILED DESCRIPTION OF THE INVENTION

Figure 1:
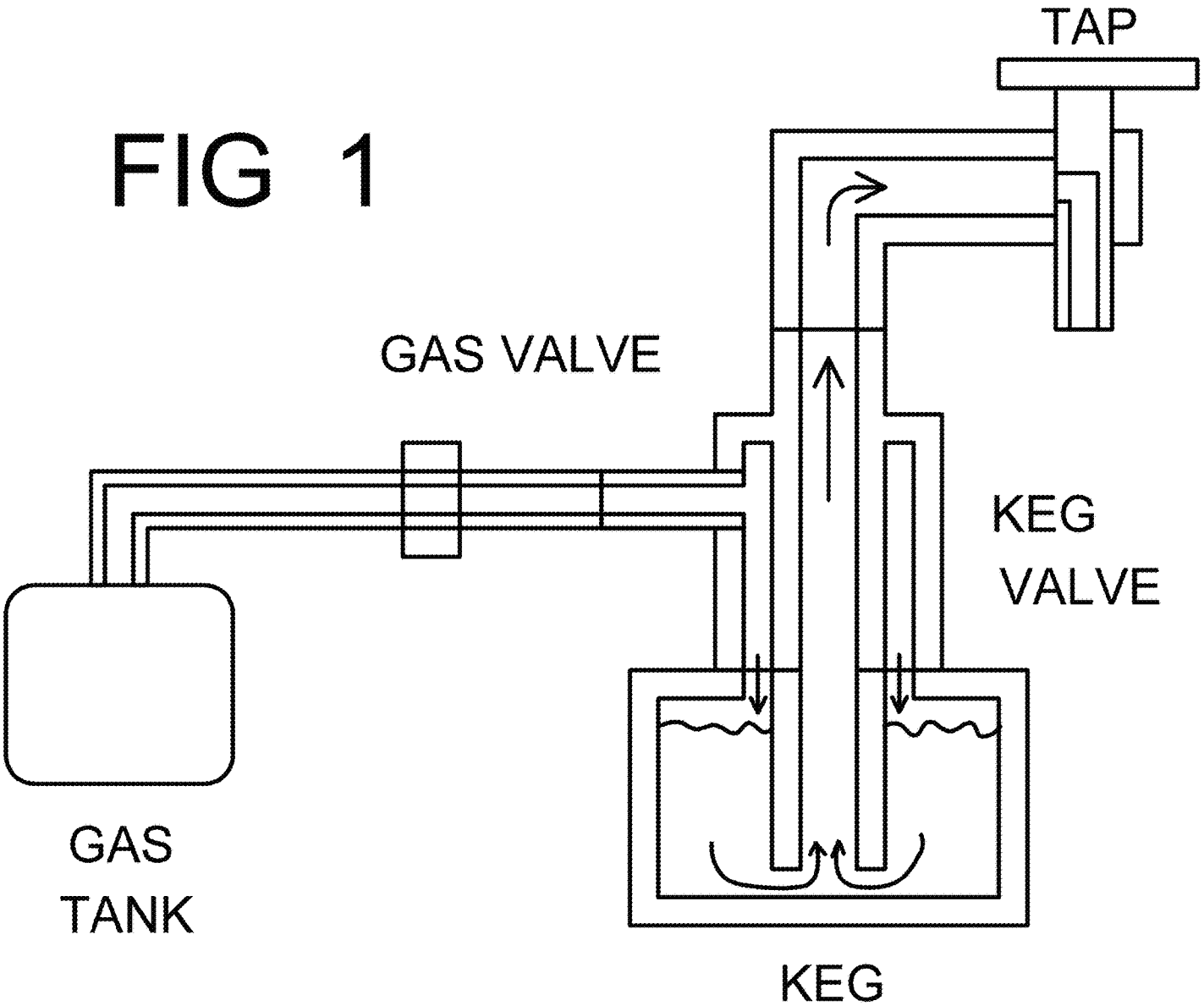
FIG. 1 shows a diagram of a liquid delivery system, with the keg in place, including the general features of one embodiment of the present invention.
Figure 2:
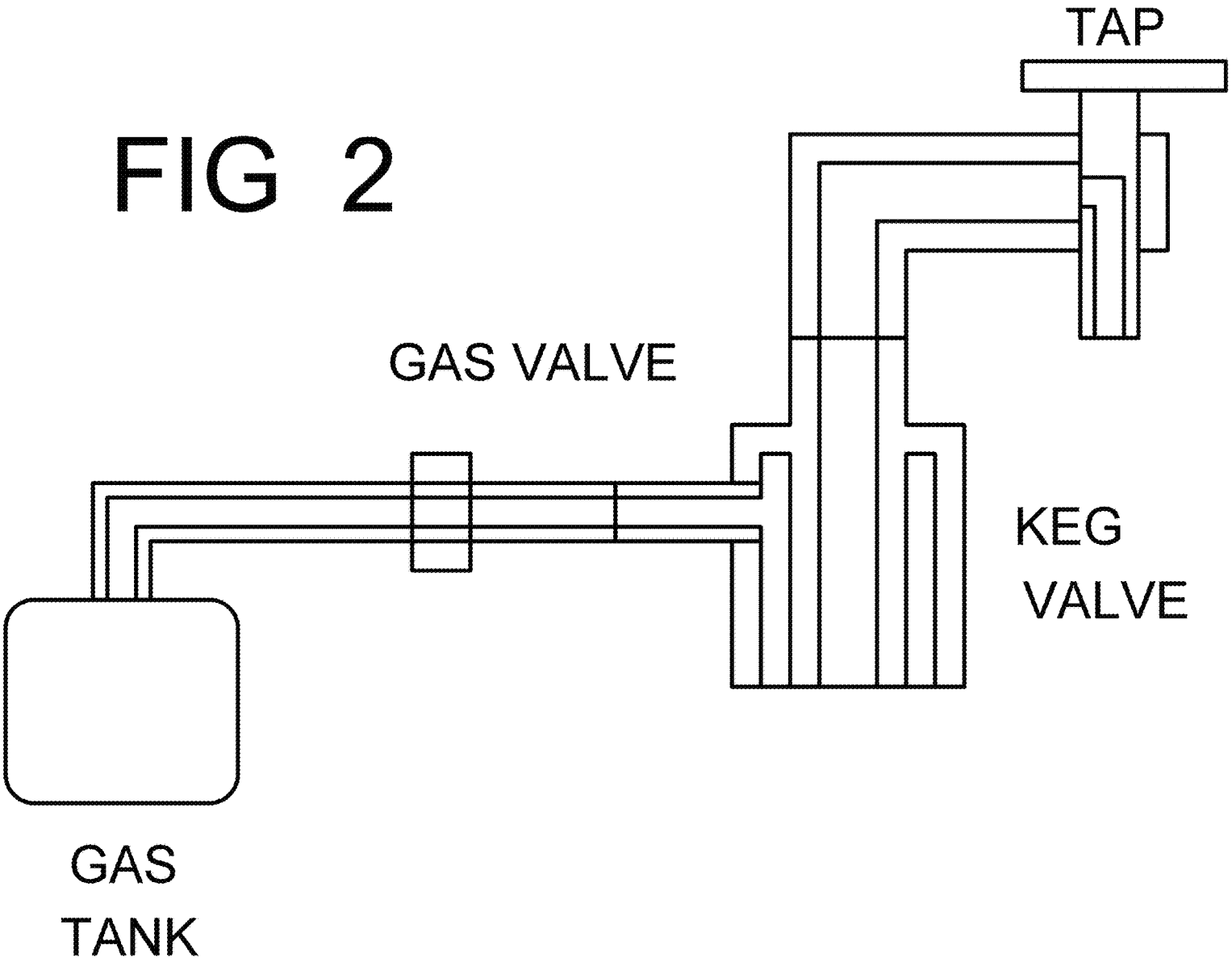
FIG. 2 shows a diagram of a liquid delivery system, with the keg removed, including the general features of one embodiment of the present invention.
Figure 3:
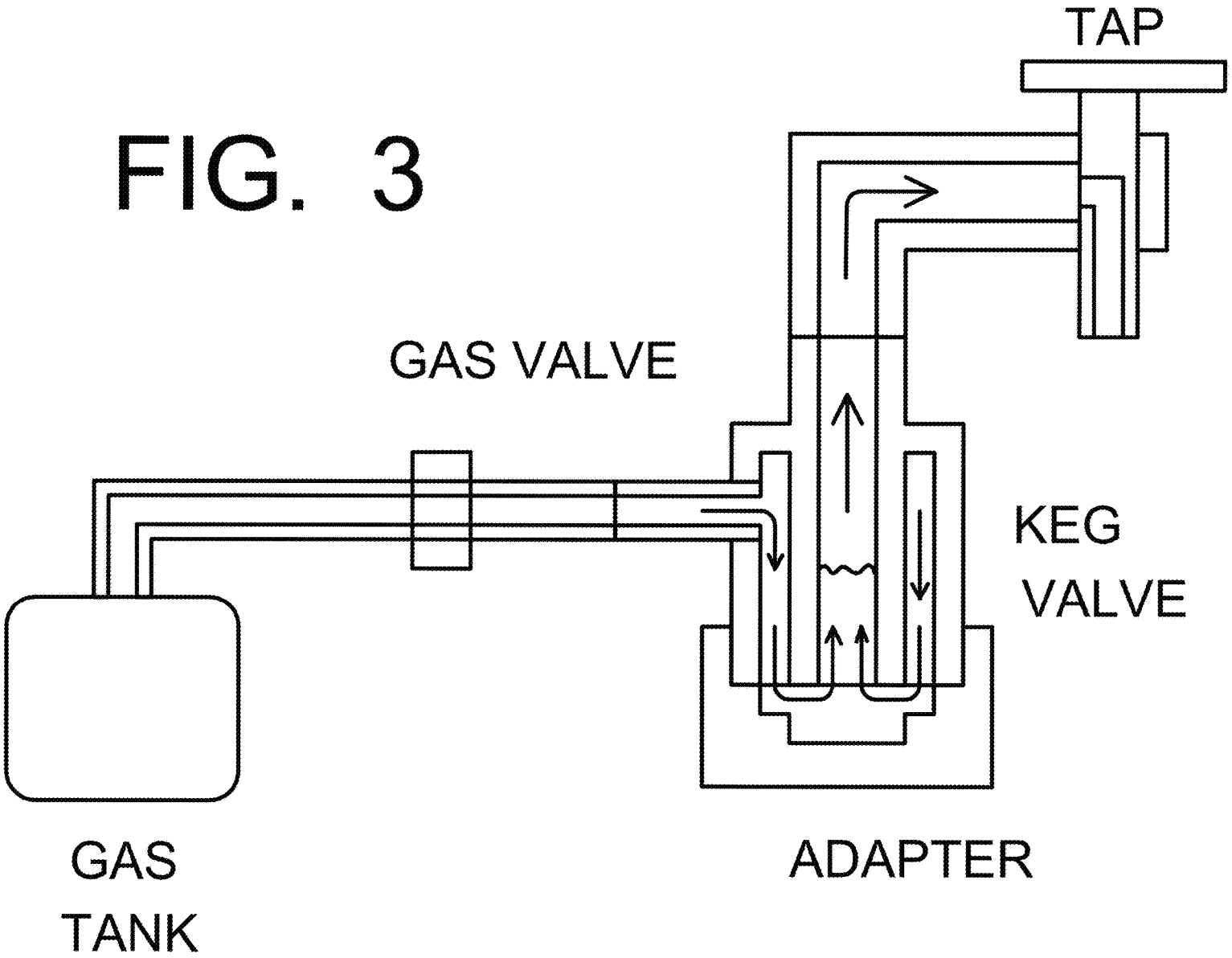
FIG. 3 shows a diagram of a liquid delivery system, with the adapter in place to redirect the gas, including the general features of one embodiment of the present invention.

Referring first to FIGS. 1-3 in which the general principles of the present invention are shown, FIG. 1 shows the liquid delivery system with the keg installed. FIG. 2 shows the liquid delivery system with the keg removed. FIG. 3 shows the liquid delivery system with the gas redirection adapter installed, so that the gas can push the residual liquid through the tap.

This invention is used prior to cleaning the lines of liquid delivery system, such as a draft beer delivery system before the lines are cleaned. The invention avoids waste of the residual liquid in the liquid delivery system by allowing the residual liquid to be pushed through the delivery tap and dispensed in the normal course of business. When the residual liquid is completely pushed out of the system, the system lines can be cleaned, without wasting liquid.

The adapter which one aspect and embodiment of this invention is a single piece of 303 stainless steel that is designed to use on either the D series or S series Sankey-Brand keg couplers/keg valves. However, it can be adapted for analogous use on other keg valves.

PURPOSE: When the fixture is connected to a Sankey-Brand keg coupler/valve, it allows the existing gas supply/pressure to enter the product line and push the remaining fluid in the line out to the beer faucet "tap" and completely empty the line of fluid.

This product is not limited to draft beer lines, it can be used on any system that uses the D or the S series Sankey-Brand keg couplers such as kegged wine, juice, soda, cocktails or other kegged beverage, and can be used or adapted to other keg valves.

INTENT: Primary Use: Each time (varies by location, industry standard is 14 days) a bar/restaurant has its beverage (beer, wine, juice, soda, cocktails or other beverage) line(s) cleaned, the product/beverage that is in the long line between the keg and the tap needs to be removed. Normally, it is drained from the keg end and dumped down the drain to allow the cleaning solution to fill the line(s). This is product that the proprietor paid for, but cannot sell. It is actual product waste and lost potential revenue (See example). This is particularly wasteful when expensive craft beers or expensive wine are involved.

Example

A 10 line beer system has a line length of 100 ft, @ 0.75 oz per ft. each line holds 75 oz. of beer/product this is equivalent to 5, 15 oz. glasses. Let's say each glass sells for $5.00 in this example.

This would yield roughly 50 glasses of beer on a 10 line system, bringing in an additional $250 that would normally have been wasted during a single line cleaning.

Weekly Cleaning: $250/week×52 weeks=$13,000.00 additional revenue per year. Bi-Weekly Cleaning: $250/week×26 weeks=$6,500.00 additional revenue per year.

Because line cleaning is done on a regular schedule, the proprietor can, at a pre-determined time, the night before line cleaning, install one of these fixtures or adapters on each of the keg valves of each of the beer/product lines (See procedure) and sell the content of the line until it completely empties. This will leave no product in the line for the line cleaner to "dump" the next morning. The line cleaner simply removes the adapters, sets them aside for the proprietor, loads in their cleaning solution and cleans as they normally would. When the line cleaner is done cleaning they would re-tap the kegs as they normally would and pull fresh beer from the keg to the faucet or tap.

Procedure/Installation:

1) Disconnect (un-tap) the Sankey-Brand keg coupler from the desired keg.

2) Holding the Sankey-Brand keg coupler in your hand, attach the (SOS) fixture or adapter to the bottom of the Sankey-Brand keg valve and rotate the adapter counter-clockwise a ¼ turn or until tight.

3) Engage (depress) the handle on the Sankey-Brand coupler just as you would on the barrel. NOTE: if your system has a FOB device, place the FOB in bypass.

At this point you can pour the product until the line is emptied.

Secondary Use: This fixture/adapter can be used by any industry service technician to quickly empty or "blow out" a line that needs service or repair.

NOTES: There is no known adverse effect to a beverage line being emptied in this manner. The end result of using this device/part/adapter can be achieved by using or modifying various parts sold as "beer line cleaning" adaptors or flushers. Although these adaptors/flushers are available in all shapes and forms from many manufacturers, they are all based on letting an external fluid (cleaner or water) enter the line through the device.

I believe the device/part which is the subject of this invention protects the drinking public because it reduces the risky temptation for the proprietors to try to do the cleaning process themselves, in order to try to capture the wasted beer. This device allows the proprietors to capture the full value of the residual beverage before the cleaning crew arrives. It also protects the "beer line" cleaning industry from putting line cleaning components in the proprietor's hands, which could lead the proprietor to make a costly, wasteful and potentially unsafe mistakes trying to clean their own lines. Beer line cleaning chemicals are caustic and acid based, they should be used by trained professionals and are not safe for consumption.

FIG. 1 shows a schematic view of the liquid delivery system with the keg valve, shown installed in the keg. Basically, the gas tank feeds pressurized carbon dioxide into the input path of the keg valve. The keg valve feeds the gas into the top portion of the keg and the establishes pressure over the beer. That pressure pushes the beer, through and exit path of the keg valve, and through the beer line, to the beer tap. In other words, the keg attached to the open end of the keg valve. Gas pressure is fed into the peripheral chamber of the keg valve and then downward to fill the space above the beer in the keg with pressurized gas. This pressurized gas acts on the upper surface of the beer in the keg and causes beer to flow up through the central tube into the keg valve and then through the beer line, to the tap, from which the beer is dispensed.

FIG. 2 is a schematic view of the liquid delivery system, with the keg valve separated from the keg, and the input path and exit path open. If the tap is opened, air enters the top of the liquid line, and the residual liquid (e.g., beer), will drain down through and out the open keg valve and into the sewer. This empty line condition is the configuration in which cleaning fluid is pumped through the keg value, through the beer line, and through the beer tap. This is done after the beer is removed from the keg, from the beer line, and from the beer tap.

When the keg is removed, we see the view in FIG. 2, but in which the beer line from the keg valve to the tap is filled with beer. In order to clean out that beer line, it is necessary to remove the beer from the beer line, and, traditionally, it is simply drained out and disposed of, causing a loss of value.

FIG. 3 shows the invention adapter installed on liquid delivery system, and flowably connecting the input path to the exit path. This essentially closes off the open end of the keg valve, while allowing the pressurized gas to pass from the gas tank up into the beer line, so that the beer is pushed through the beer line, and through the tap, and can be sold. When the beer is finally removed from the beer line, the beer line can be cleaned without any wastage of the beer.

Figure 4:
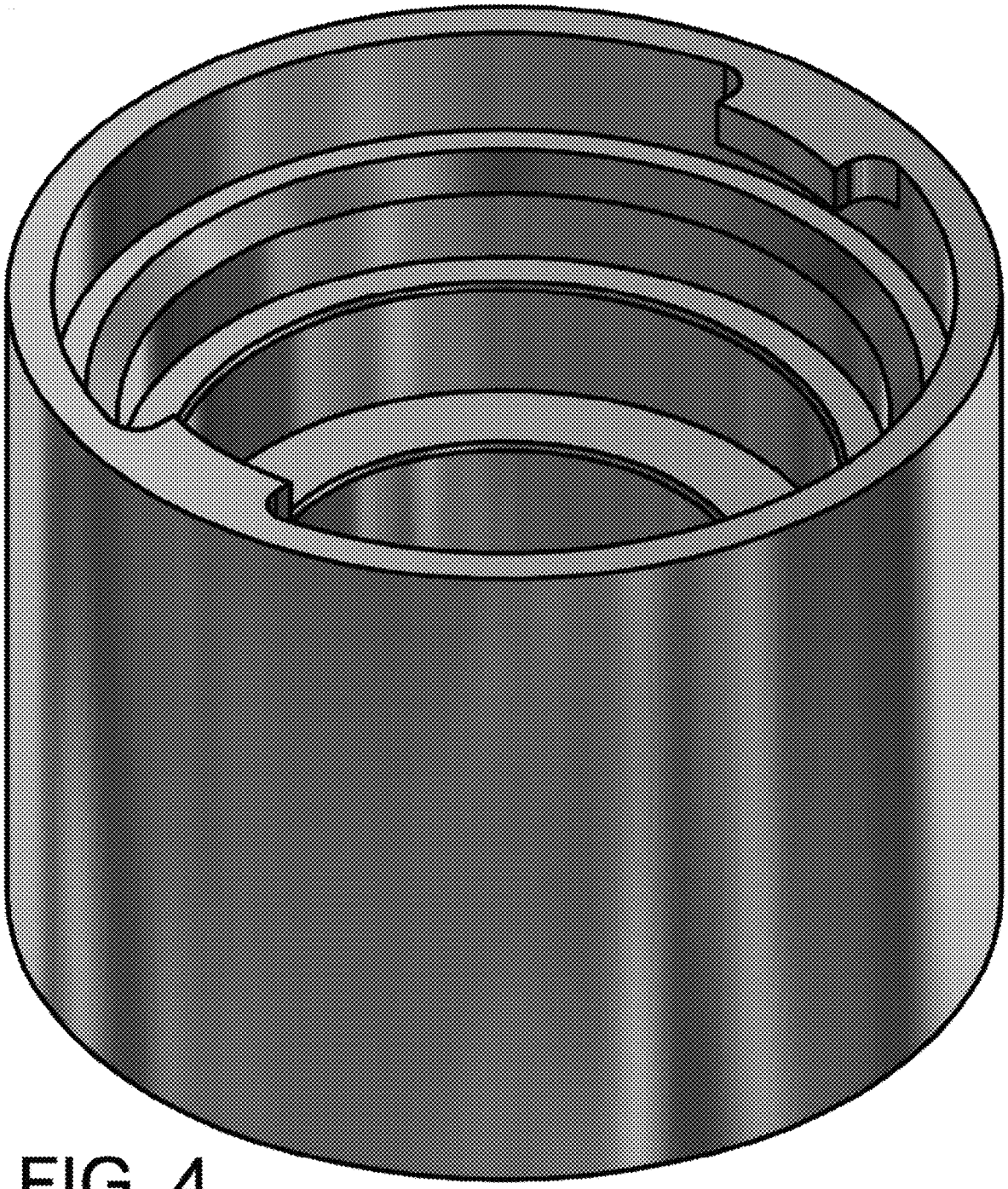
FIG. 4 shows a perspective view of an adapter, for redirecting the gas in a liquid delivery system, including the general features of one embodiment of the present invention.

FIG. 4 shows a perspective view of the invention adapter, detailing the stepped concentric rings that allow the gas to enter the adapter through the outer peripheral ring of the keg valve, inward through the adapter, and inton the central cavity of the adapter, and upward, through the central exit port of the keg valve into the beer line.

Figure 5:
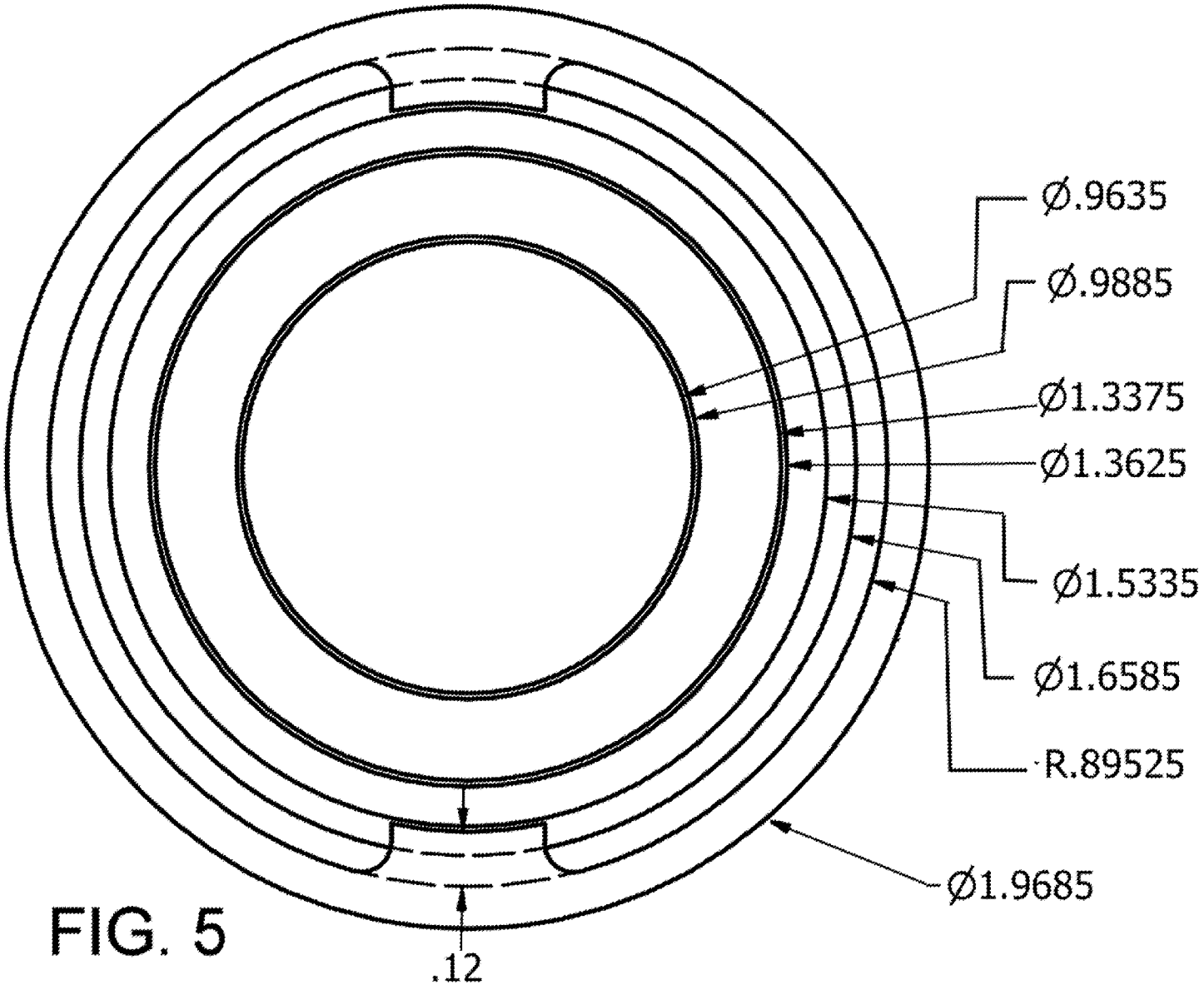
FIG. 5 shows a plan/top view of an adapter, for redirecting the gas in a liquid delivery system, including the general features of one embodiment of the present invention.

FIG. 5 shows a top view of the invention adapter, detailing the stepped concentric rings.

Figure 6:
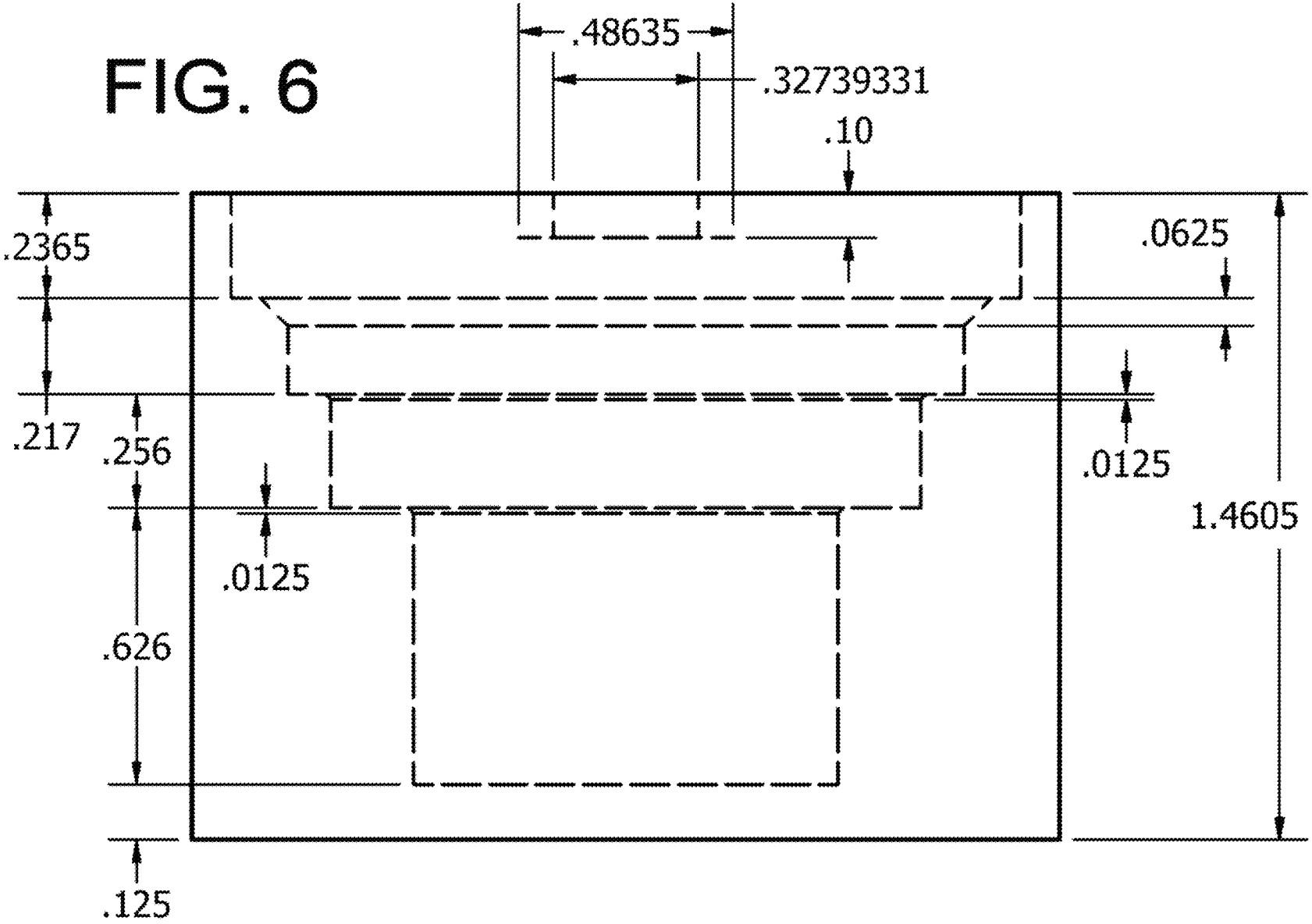
FIG. 6 shows a front elevation view of an adapter, for redirecting the gas in a liquid delivery system, including the general features of one embodiment of the present invention.

FIG. 6 shows a front view of the invention adapter, detailing the stepped concentric rings.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. A method of capturing liquid from a feed line of a liquid delivery system, said system including liquid container, a delivery tap, a gas source, a liquid delivery line from the liquid container to the tap, the liquid delivery line containing liquid, and a gas line from the gas source to the liquid container, the gas line containing gas; the method comprising the steps of:

a. disconnecting the gas line and the liquid delivery line from the liquid container, b. flowably connect the gas line and the liquid delivery line with an adapter, and c. causing the gas in the gas line to push the liquid out of the liquid delivery line through the tap, wherein both the gas line and the liquid delivery line are both connected to a keg valve and the keg valve is normally connected to the liquid container, and the adapter replaces the liquid container.

* * * * *